US012774602B2

(12) United States Patent
Dudhia

(10) Patent No.: US 12,774,602 B2
(45) Date of Patent: Oct. 27, 2026

(54) PROTECTIVE COVERS

(71) Applicant: Shiraz Dudhia, Hornchurch (GB)

(72) Inventor: Shiraz Dudhia, Hornchurch (GB)

( * ) Notice: Subject to any disclaimer, the term of this patent is extended or adjusted under 35 U.S.C. 154(b) by 178 days.

(21) Appl. No.: 18/703,000

(22) PCT Filed: Oct. 17, 2022

(86) PCT No.: PCT/GB2022/052642

§ 371 (c)(1),
(2) Date: Apr. 19, 2024

(87) PCT Pub. No.: WO2023/067320

PCT Pub. Date: Apr. 27, 2023

(65) Prior Publication Data

US 2024/0417974 A1 Dec. 19, 2024

(30) Foreign Application Priority Data

Oct. 19, 2021 (GB) ..... 2114916

(51) Int. Cl.
*E04C 5/16* (2006.01)
*E04G 5/00* (2006.01)
*E04G 21/32* (2006.01)

(52) U.S. Cl.
CPC ..... *E04C 5/161* (2013.01); *E04G 5/002* (2013.01); *E04G 21/3252* (2013.01)

(58) Field of Classification Search
CPC ..... E04C 5/161; E04G 5/002; E04G 21/3252
USPC ..... 52/301, 689, 677; 248/523, 188.9
See application file for complete search history.

(56) References Cited

U.S. PATENT DOCUMENTS 4,202,378 A * 5/1980 Bush ..... B65D 59/06 411/908
D262,093 S * 12/1981 Bush ..... D25/135
5,600,927 A * 2/1997 Kennon ..... E04G 21/3252 52/301
5,943,836 A * 8/1999 Kassardjian ..... E04G 21/32 52/300
6,021,614 A * 2/2000 Krieger ..... E04H 12/04 52/301
7,716,898 B1 5/2010 Dunn
8,141,309 B2 * 3/2012 Kubicek ..... E04C 5/161 52/301

(Continued)

FOREIGN PATENT DOCUMENTS

AU 2004100262 A4 4/2004
AU 2006101065 A4 * 2/2007

(Continued)

OTHER PUBLICATIONS

Barcessat, L. (Authorized officer), International Search Report and Written Opinion in corresponding International Application No. PCT/GB2022/052642 mailed on Jan. 18, 2023, 10 pages.

*Primary Examiner* — Brent W Herring
(74) *Attorney, Agent, or Firm* — MH2 Technology Law Group LLP

(57) ABSTRACT

A construction-related rod free end cover comprises a main body formed of a deformable thermoplastic elastomer. The main body has at a first end an outer wall and at a second end an opening to a substantially central chamber. At least part of the chamber is configured to deform to releasably attach the cover to a free end of a construction-related rod.

16 Claims, 4 Drawing Sheets

(56) References Cited

U.S. PATENT DOCUMENTS

| | | | | |
|---|---|---|---|---|
| D737,120 | S * | 8/2015 | Recker | D8/354 |
| 10,927,549 | B1 * | 2/2021 | Lunsford | E04C 5/161 |
| 11,898,352 | B2 * | 2/2024 | Pomey | E04C 5/161 |
| 2002/0108321 | A1 * | 8/2002 | Schimmelpfennig | E04G 21/3252 52/90.1 |
| 2009/0313927 | A1 | 12/2009 | Myers et al. | |
| 2018/0334807 | A1 * | 11/2018 | Ryan | E04C 5/161 |

FOREIGN PATENT DOCUMENTS

| | | | |
|---|---|---|---|
| DE | 1157436 | B | 11/1963 |
| WO | 2015109288 | A2 | 7/2015 |
| WO | 2017089948 | A1 | 6/2017 |

* cited by examiner

PROTECTIVE COVERS

CROSS-REFERENCE TO RELATED APPLICATIONS

The present application is a national stage entry from International Application No. PCT/GB2022/052642, filed on Oct. 17, 2022, published as International Publication No. WO 2023/067320 A1 on Apr. 27, 2023, and claims priority to Great Britain Patent Application No. 2114916.6, filed Oct. 19, 2021, the disclosures of all of which are hereby incorporated by reference in their entireties.

FIELD

The present invention relates to a protective cover. In particular the present invention relates to protective covers for the free ends of construction-related rods including bolts and rebar.

BACKGROUND

Rebar (short for reinforcing bar) is a steel bar or mesh of steel wires used as a tension device in reinforced concrete and reinforced masonry structures to strengthen concrete under tension.

However, whilst construction is ongoing the free ends of rebar are often exposed, posing a significant health and safety risk.

Statistics compiled by a US body, the Occupational Safety and Health Administration, indicate that around 60% of accidents on constructions sites relate to impalement on rebar.

Furthermore, with scaffolding the free ends of bolts are typically left exposed, again posing significant risk of injury.

The present invention seeks to address these issues.

SUMMARY

According to the present invention there is provided a construction-related rod free end cover comprising a main body formed of a deformable thermoplastic elastomer, the main body comprising: at a first end an outer wall; at a second end an opening to a substantially central chamber, wherein at least part of the chamber is configured to deform to releasably attach the cover to a free end of a construction-related rod.

By providing a cover formed of a deformable thermoplastic elastomer with a central chamber to house a free end of a rod the cover may releasably retain itself on a free end of a rod. Beneficially a single cover may house a range of rod sizes meaning that user need not search for a particular cover in order to install a protective cap on a rod of a particular diameter.

In some embodiments the main body comprises a plurality of conjoined walls extending at least partway between first and extend ends of the cover, the walls being reticulated in cross-section and arranged around the central chamber.

Provision of a plurality of reticulated walls arrange around the central chamber provides the cover with impact resistance such that the attachment of the cover to the rod is not disrupted thereby hindering the cover from being accidentally dislodged.

In some embodiments the chamber is configured to elastically deform to provide an interference fit with a free end of a rod.

In some embodiments the chamber comprises a plurality of deformable members arranged around its periphery and extending from an inner wall of the chamber towards its centre.

Provision of a plurality of elastically deformable members enables a cover to releasably grip a free end of a rod.

In some embodiments the deformable members are elongate fins.

In some embodiments a chamber is substantially polygonal in shape.

In some embodiments deformable members extend inwardly from corners of the polygon.

In some embodiments the chamber is substantially hexagonal in cross-section.

Provision of a hexagonal chamber provides protection against unintentional dislodging of a cover.

In some embodiments when a cover is not in use the length of each side of a hexagonal chamber is between 0.5 cm and 3 cm, or is less than 2.5 cm, or is between 1 cm and 2 cm, or is less than around 1.5 cm, or is around 1.2 cm.

In some embodiments a cover comprises a secondary polygonal chamber within the central chamber.

In some embodiments the secondary polygonal chamber is formed of walls that extend from the first end towards the second end no more than 50% of the length of central chamber, or no more than 40% of the length of the central chamber, or no more than 30% of the length of the central chamber.

In some embodiments the secondary polygonal chamber is substantially hexagonal.

In some embodiments walls of the secondary polygonal chamber intersect the deformable members.

In some embodiments the chamber is substantially cylindrical.

In some embodiments when a cover is not in use its chamber has a diameter of between 5 and 20 mm, or of between 6 and 18 mm, or of between 7 and 16 mm, or of between 8 mm and 14 mm, or of between 9 mm and 13 mm, or of between 10 mm and 12 mm, or of around 11 mm.

In some embodiments an inner wall of the chamber comprises a plurality of recesses spaced apart along a longitudinal axis of the chamber.

In some embodiments recesses are substantially circular.

Circular recesses allow the chamber to readily grip the thread of a bolt, as sections of thread are housed in the recesses so as to provides protection against unintentional dislodging of a cover.

In some embodiments the cover comprises a hexagonal wall structure positioned between the chamber and an outer wall of the cover.

In some embodiments when a cover is not in use the length of each side of a hexagonal wall structure is between 0.5 cm and 3 cm, or is less than 2.5 cm, or is between 1 cm and 2 cm, or is less than around 1.5 cm, or is around 1.2 cm.

In some embodiments the thermoplastic elastomer has a hardness on the Shore A scale of between 20 and 80, or of between 30 and 70, or of between 40 and 60, or of around 50.

In some embodiments the construction-related rod is rebar.

In some embodiments the construction-related rod is a bolt.

In some embodiments the outer wall at the first end is curved.

In some embodiments the outer wall at the first end is substantially hemispherical.

BRIEF DESCRIPTION OF THE DRAWINGS

In order that the present invention may be more fully understood a specific embodiment will now be described by way of example with reference to the accompanying schematic drawings, of which.

DETAILED DESCRIPTION

Figure 1:
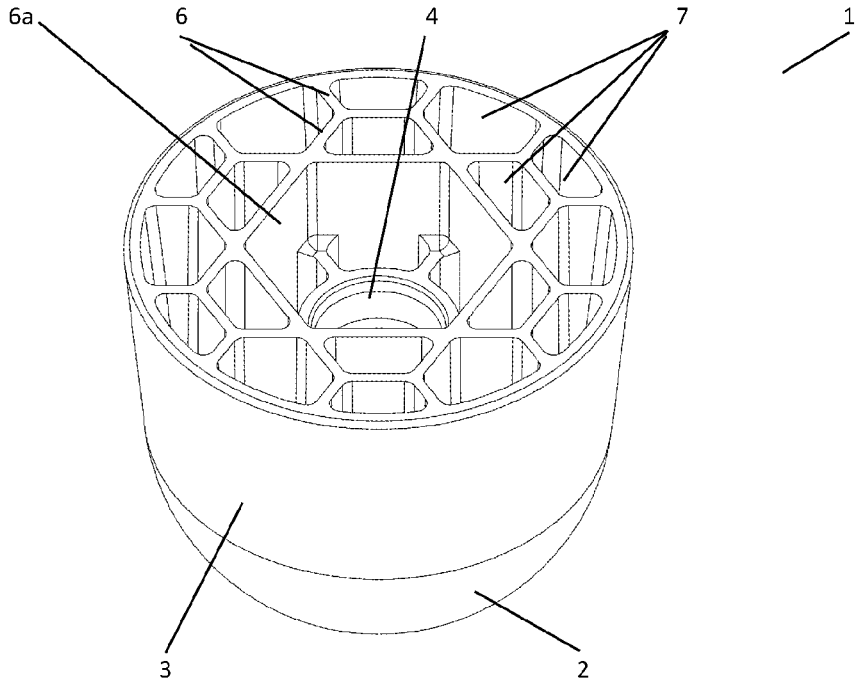
FIG. 1 is a perspective view of a bolt cover made in accordance with the present invention.
Figure 2:
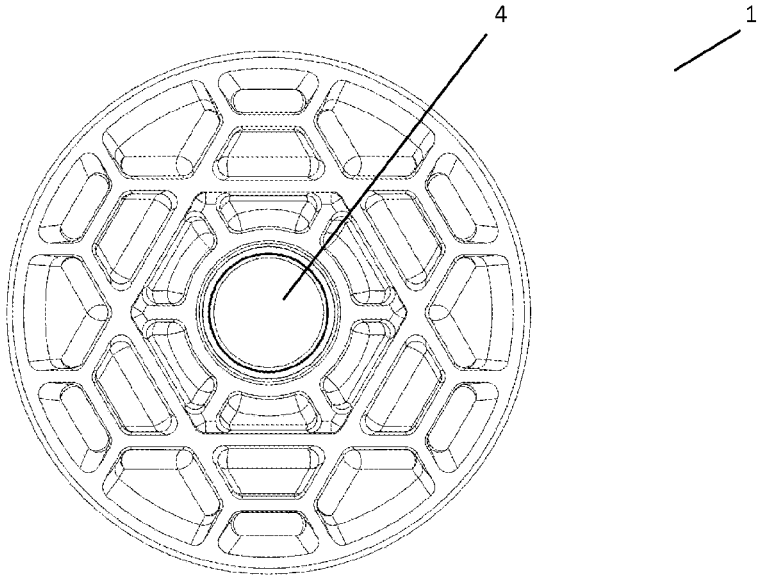
FIG. 2 is a plan view of the bolt cover of FIG. 1.
Figure 3:
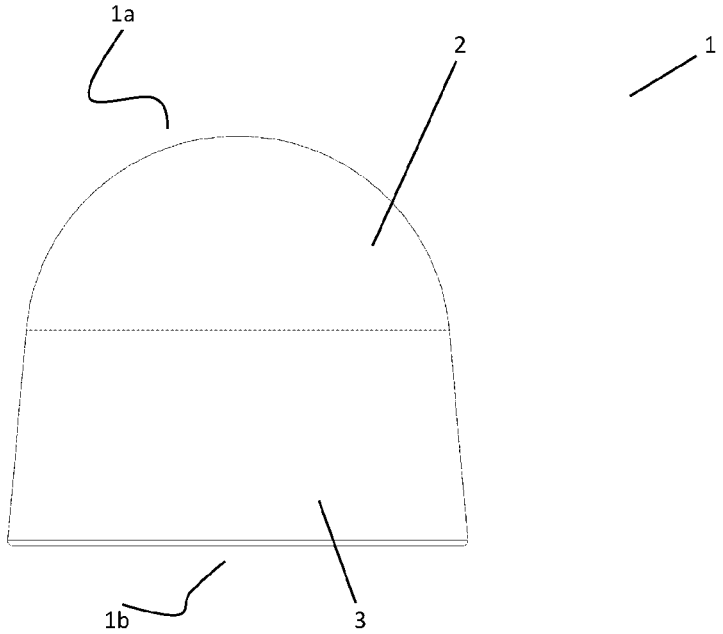
FIG. 3 is a side view of the bolt cover of FIG. 1.
Figure 4:
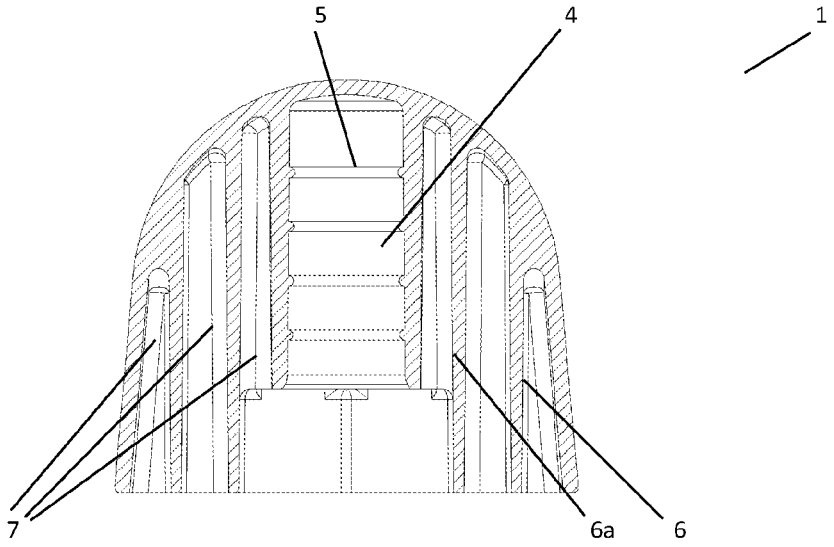
FIG. 4 is a cross-section of the bolt cover of FIG. 1.

Referring to FIGS. 1 to 4, a bolt cover 1 comprises at a first end 1*a* a curved, substantially hemispherical, outer wall 2.

Cover 1 is formed of a resiliently flexible thermoplastic elastomer having a hardness of around 50 on the Shore A scale.

A substantially frustoconical outer wall 3 extends from hemispherical wall 2 to terminate at a second end 1*b* of cover 1.

Second end 1*b* of cover 1 is substantially circular and comprises an opening to a substantially central chamber 4 that is configured to releasably house a free end of a bolt (not shown).

Cover 1 is approximately 5 cm in length between its first and second ends 1*a*, 1*b*. Substantially circular second end 1*b* of cover 1 is approximately 4.5 cm in diameter Chamber 4 is substantially cylindrical and comprises a plurality of substantially circular recesses 5 spaced apart along the longitudinal axis of chamber 4. In the present embodiment six recesses 5 are provided.

Chamber 4 has a diameter of approximately 11.4 mm and is configured to attach to bolts by means of an interference fit.

As cover 1 is formed of a flexible thermoplastic elastomer having a hardness of around 50 on the Shore A scale chamber 4 is capable of stretching to accommodate bolts having a diameter of between 12 mm and 20 mm.

Scaffold bolts are typically 16 mm in diameter, and it is therefore desirable for any cover intended for use with such bolts to have a chamber with a sufficiently smaller diameter such that an effective interference fit may be obtained.

Recesses 5 are intended in use to house portions of screw thread of a bolt and thereby enhance the attachment of cover 1 to a bolt.

A plurality of conjoined inner walls 6 are arranged around chamber 4 between chamber 4 and outer walls 2, 3.

Inner walls 6 extend from an internal face of wall 2 towards second end 1*b* of cover 1.

Inner walls 6 are reticulated in cross-section such that they form a plurality of elongate pockets 7 arranged around the periphery of cover 1. Pockets 7 extend from first end 1*a* of towards second end 1*b* of cover 1.

Inner walls also define a hexagonal wall structure 6*a* positioned between chamber 4 and outer wall 3.

Walls 6 and pockets 7 act to protect chamber 4 and its interference fit with a bolt when cover 1 is in use. Hexagonal wall structure 6*a* provides a strong protective surround for chamber 4

Figure 5:
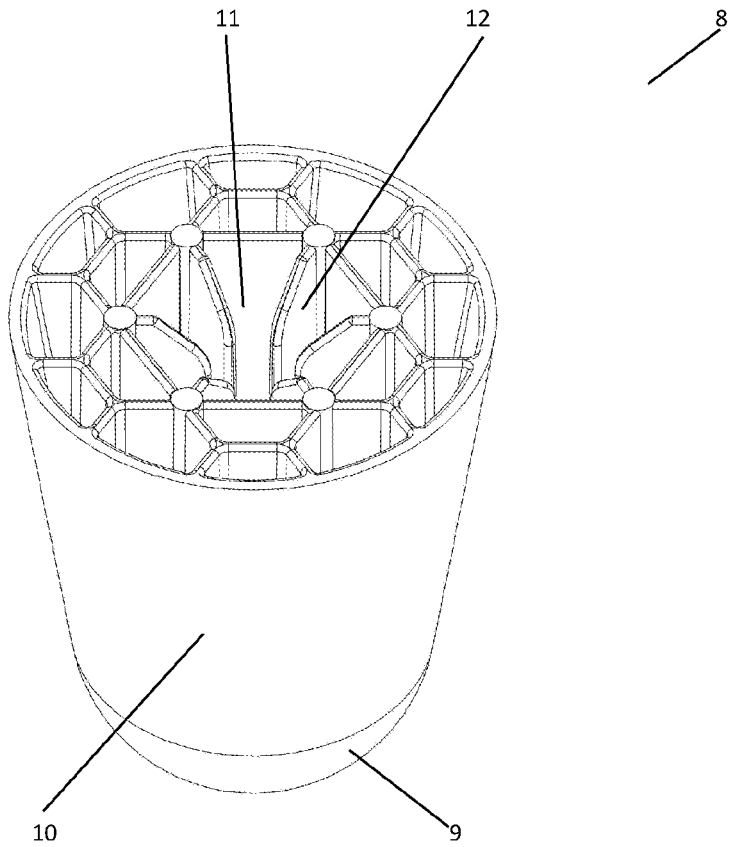
FIG. 5 is a perspective view of a rebar cover made in accordance with the present invention.
Figure 6:
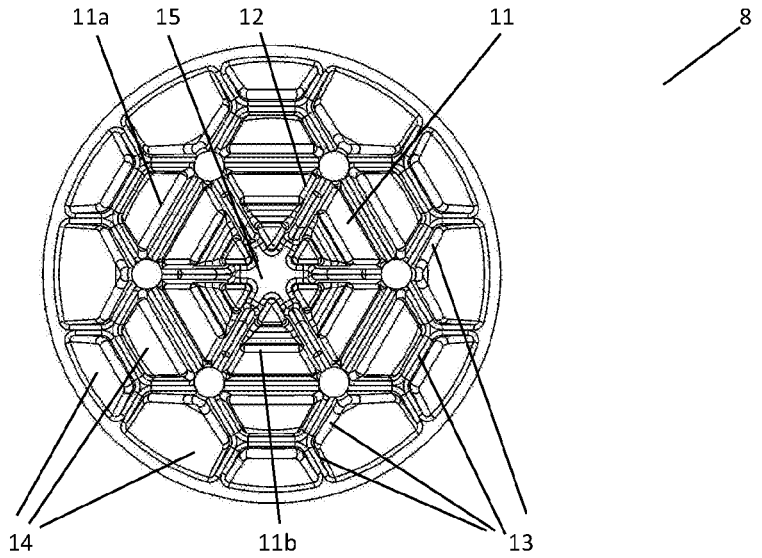
FIG. 6 is a plan view of the rebar cover of FIG. 5.
Figure 7:
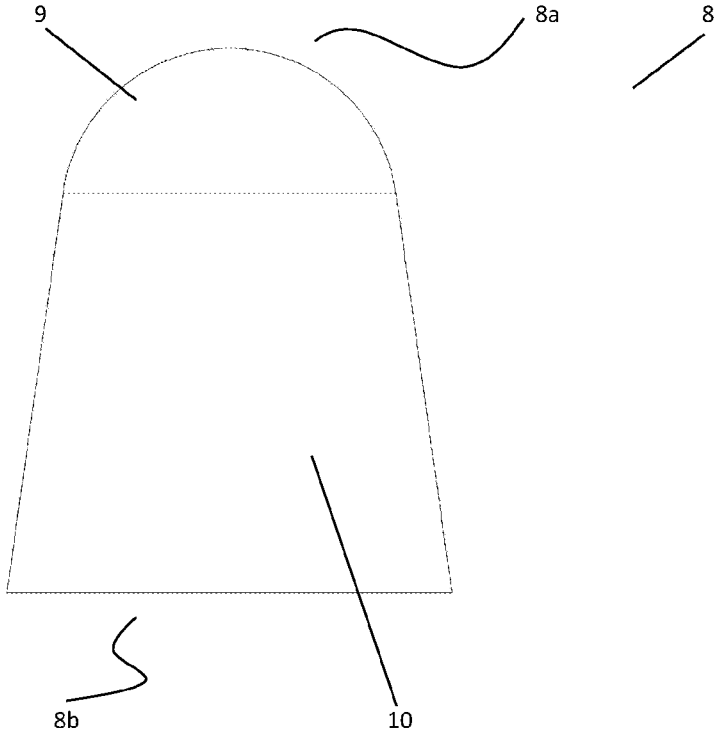
FIG. 7 is a side view of the rebar cover of FIG. 5.
Figure 8:
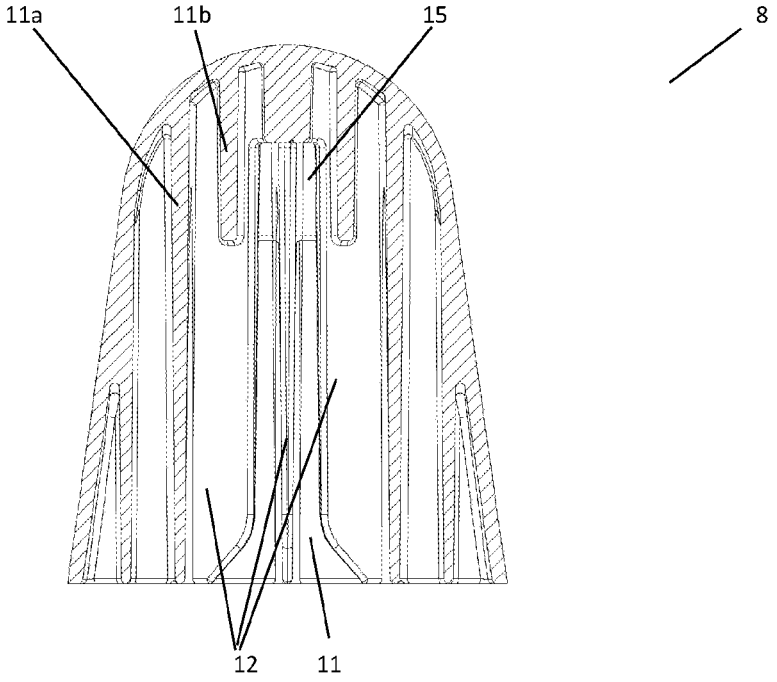
FIG. 8 is a cross-section of the rebar cover of FIG. 5.

Referring to FIGS. 5 to 8, a rebar cover 1 comprises at a first end 8*a* a curved, substantially hemispherical, outer wall 9.

Cover 8 is formed of a resiliently flexible thermoplastic elastomer having a hardness of around 50 on the Shore A scale.

A substantially frustoconical outer wall 10 extends from hemispherical wall 9 to terminate at a second end 8*b* of cover 8.

Second end 8*b* of cover 8 is substantially circular and comprises an opening to a substantially central chamber 11 that is configured to releasably house a free end of a length of rebar (not shown).

Cover 8 is approximately 5.5 cm in length between its first and second ends 8*a*, 8*b*. Substantially circular second end 8*b* of cover 8 is approximately 4.5 cm in diameter Chamber 11 is defined by chamber walls 11*a*. Chamber 11 is substantially hexagonal and comprises six elongate fins 12 extending inwardly from respective corners of the hexagon towards the centre of chamber 11.

Fins 12 are elongate in that they extend along the longitudinal axis of chamber 11 between ends 8*a*, 8*b* of cover 8. Fins 12 are tapered at their free ends adjacent second end 8*b* and the opening to chamber 11 so as to aid insertion of a length of rebar into chamber 11.

The length of each side of hexagonal chamber 11 is approximately 1.2 cm, and the gap between opposing fins 12 is approximately 0.5 cm.

Inside chamber 11 and located adjacent the internal face of wall 9 is a diminutive secondary hexagonal chamber 15 formed of walls 11*b*. Walls 11*b* are each approximately 0.75 cm in length and extend from inner face of wall 9 approximately 1.75 cm.

Walls 11*b* intersect fins 12 and around their lateral midpoints and thereby provide support to fins 12.

Secondary hexagonal chamber 15 may also receive the tip of a length of rebar when cover 1 is employed with rebar of low diameters, thereby assisting in retaining cover 1 in position.

As cover 1 is formed of a flexible thermoplastic elastomer having a hardness of around 50 on the Shore A scale fins 12 and chamber 11 are capable of deforming so as to releasably attach to rebar having a diameter of approximately 8 to 20 mm.

In other embodiments covers comprising differently sized chambers and fins may be provided so as to fit rebar having different dimensions. For example a cover may be sized so as to fit rebar of diameter 16 mm to 32 mm, or a cover may be sized to fit rebar of diameter 40 mm to 50 mm.

A plurality of conjoined inner walls 13 are arranged around chamber 11 between chamber 11 and outer walls 9, 10.

Inner walls 13 extend from an internal face of wall 9 towards second end 8*b* of cover 8.

Inner walls 13 are reticulated in cross-section such that they form a plurality of elongate pockets 14 arranged around the periphery of cover 8. Pockets 14 extend from first end 8*a* of towards second end 8*b* of cover 8.

Walls 13 and pockets 14 act to protect chamber 11 and its attachment to a length of rebar when cover 8 is in use.

Whilst in the present embodiment a thermoplastic elastomer with a hardness of around 50 on the Shore A scale is employed in other embodiments any suitable material may be employed. It is preferable that any material is UV stable and resistant to temperature fluctuations of at least −10 to +40 degrees Celsius.

In some embodiments the thermoplastic elastomer used may be biodegradable.

In this specification an apparatus/method/product "comprising" certain features is intended to be interpreted as meaning that it includes those features, but that it does not exclude the presence of other features.

Many variations are possible without departing from the scope of the present invention as defined in the appended claims.

The invention claimed is:

1. A construction-related rod free end cover comprising a main body formed of a deformable thermoplastic elastomer, the main body comprising:

at a first end an outer wall; and at a second end an opening to a first polygonal chamber that is substantially central to the construction-related rod free end cover, wherein at least part of the first chamber is configured to deform to releasably attach the cover to a free end of a construction-related rod;

wherein the first polygonal chamber comprises a plurality of deformable members arranged around its periphery and extending from an inner wall of the first polygonal chamber towards its centre;

wherein the cover comprises a secondary polygonal chamber within the first polygonal chamber; and wherein the main body comprises a plurality of conjoined walls extending at least partway between first and extend ends of the cover, the walls being reticulated in cross-section and arranged around the secondary polygonal chamber.

2. The cover of claim 1 wherein the first polygonal chamber is configured to elastically deform to provide an interference fit with a free end of a rod.

3. The cover of claim 1 wherein the deformable members are elongate fins.

4. The cover of claim 1 wherein the first polygonal chamber is substantially hexagonal in cross-section.

5. The cover of claim 4 wherein when the cover is not in use a length of each side of the first polygonal chamber that is hexagonal in cross section is between 0.5 cm and 3 cm.

6. The cover of claim 1 wherein the secondary polygonal chamber is substantially hexagonal.

7. The cover of claim 1 wherein walls of the secondary polygonal chamber intersect the deformable members.

8. The cover of claim 1 wherein the cover comprises a hexagonal wall structure positioned between the first polygonal chamber and an outer wall of the cover.

9. The cover of claim 8 wherein when the cover is not in use a length of each side of a hexagonal wall structure is between 0.5 cm and 3 cm.

10. The cover of claim 1 wherein the thermoplastic elastomer has a hardness on the Shore A scale of between 20 and 80.

11. The cover of claim 1 wherein the construction-related rod is a rebar.

12. The cover of claim 1 wherein the construction-related rod is a bolt.

13. The cover of claim 1 wherein the outer wall at the first end is curved.

14. The cover of claim 1 wherein the outer wall at the first end is substantially hemispherical.

15. A construction-related rod free end cover comprising a main body formed of a deformable thermoplastic elastomer, the main body comprising:

at a first end an outer wall; and at a second end an opening to a first polygonal chamber that is substantially central to the construction-related rod free end cover, wherein at least part of the first polygonal chamber is configured to deform to releasably attach the cover to a free end of a construction-related rod;

wherein the first polygonal chamber comprises a plurality of deformable members arranged around its periphery and extending from an inner wall of the first polygonal chamber towards its centre;

wherein the cover comprises a secondary polygonal chamber within the first polygonal chamber;

wherein the main body comprises a plurality of conjoined walls extending at least partway between first and second ends of the cover, the walls being reticulated in cross-section and arranged around the first polygonal chamber; and wherein deformable members extend inwardly from corners of the first polygonal chamber.

16. A construction-related rod free end cover comprising a main body formed of a deformable thermoplastic elastomer, the main body comprising:

at a first end an outer wall; and at a second end an opening to a first polygonal chamber that is substantially central to the construction-related rod free end cover, wherein at least part of the first polygonal chamber is configured to deform to releasably attach the cover to a free end of a construction-related rod;

wherein the first polygonal chamber comprises a plurality of deformable members arranged around its periphery and extending from an inner wall of the first polygonal chamber towards its centre;

wherein the cover comprises a secondary polygonal chamber within the first polygonal chamber;

wherein the main body comprises a plurality of conjoined walls extending at least partway between first and second ends of the cover, the walls being reticulated in cross-section and arranged around the first polygonal chamber; and wherein the secondary polygonal chamber is formed of walls that extend from the first end towards the second end no more than 50% of a length of the secondary polygonal chamber, or no more than 40% of the length of the secondary polygonal chamber, or no more than 30% of the length of the secondary polygonal chamber.

* * * * *